US010926503B2

(12) United States Patent
Sassi

(10) Patent No.: US 10,926,503 B2
(45) Date of Patent: Feb. 23, 2021

(54) LINE FOR CONVEYING AND FORMING BOX-LIKE BODIES OF DIFFERENT TYPES

(71) Applicant: GIMA S.P.A., Zola Predosa (IT)

(72) Inventor: Fabio Sassi, Zola Predosa (IT)

(73) Assignee: GIMAS.P.A., Zola Predosa (IT)

( * ) Notice: Subject to any disclaimer, the term of this patent is extended or adjusted under 35 U.S.C. 154(b) by 99 days.

(21) Appl. No.: 15/762,990

(22) PCT Filed: Oct. 6, 2016

(86) PCT No.: PCT/EP2016/073916
§ 371 (c)(1),
(2) Date: Mar. 23, 2018

(87) PCT Pub. No.: WO2017/060377
PCT Pub. Date: Apr. 13, 2017

(65) Prior Publication Data

US 2018/0215118 A1 Aug. 2, 2018

(30) Foreign Application Priority Data

Oct. 8, 2015 (IT) ..... 102015000059464

(51) Int. Cl.
*B31B 50/07* (2017.01)
*B31B 50/04* (2017.01)
(Continued)

(52) U.S. Cl.
CPC ..... *B31B 50/07* (2017.08); *B31B 50/042* (2017.08); *B31B 50/58* (2017.08); *B65B 5/024* (2013.01);
(Continued)

(58) Field of Classification Search
CPC ..... B65B 35/38; B65B 35/405; B65B 35/24; B65B 5/06; B65B 5/024; B65B 2210/02;
(Continued)

(56) References Cited

U.S. PATENT DOCUMENTS 4,893,707 A * 1/1990 Langen ..... B65G 17/26 198/626.3
5,732,537 A 3/1998 Disrud
(Continued)

FOREIGN PATENT DOCUMENTS

EP 2829483 A1 1/2015
JP 2005119731 A 5/2005
(Continued)

OTHER PUBLICATIONS

International Search Report dated Jan. 19, 2017 re: Application No. PCT/EP2016/073916, pp. 1-6, citing: WO 36/30261 A1, WO 97/46374 A1, JP 2005 119731 A, US 2005/150745 A1, WO 96/10518 A1, JPH 11 59847 A, EP 2 829 483 A1, WO 2014/204583 A2 and U.S. Pat. No. 5 732 537 A.
(Continued)

*Primary Examiner* — Thomas M Wittenschlaeger
(74) *Attorney, Agent, or Firm* — Cantor Colburn LLP

(57) ABSTRACT

A line for conveying and forming box-like bodies of different types includes at least one suction belt, closed in a loop and arranged at least in its initial portion, at least one strap, closed in a loop and provided with protruding teeth. The strap is parallel to the suction belt and is arranged at least in the end portion of the line and has the initial front juxtaposed with respect to the end portion of the suction belt. The line further includes at least one band closed in a loop and provided with protruding tabs, parallel to the at least one suction belt and to the at least one strap and is arranged along the entire line, and has a start area that is juxtaposed with respect to the at least one suction belt and an end area that is juxtaposed with respect to the at least one strap.

9 Claims, 7 Drawing Sheets

(51) Int. Cl.

| | |
|---|---|
| ***B31B 50/58*** | (2017.01) |
| ***B65B 43/18*** | (2006.01) |
| ***B65B 43/26*** | (2006.01) |
| ***B65B 43/52*** | (2006.01) |
| ***B65B 59/00*** | (2006.01) |
| ***B65B 43/16*** | (2006.01) |
| ***B65B 5/02*** | (2006.01) |
| *B31B 50/00* | (2017.01) |
| *B31B 120/30* | (2017.01) |
| *B31B 110/35* | (2017.01) |

(52) U.S. Cl.
CPC ..... *B65B 43/165* (2013.01); *B65B 43/185* (2013.01); *B65B 43/265* (2013.01); *B65B 43/52* (2013.01); *B65B 59/003* (2019.05); *B65B 59/005* (2013.01); *B31B 50/00* (2017.08); *B31B 2110/35* (2017.08); *B31B 2120/302* (2017.08); *B65B 2210/02* (2013.01)

(58) Field of Classification Search
CPC ..... B65B 59/00; B65B 43/185; B65B 43/52; B65B 43/265; B65B 43/165; B65B 59/003; B65B 59/005; B65G 15/42; B65G 15/12; B65G 17/08; B65G 41/001; B65G 41/003; B31B 50/07; B31B 50/58; B31B 50/042; B31B 50/00; B31B 2110/35; B31B 2120/302
USPC ..... 198/626.3, 626.4, 867.08, 867.11, 803.4, 198/803.11, 809, 845, 844.1, 601
See application file for complete search history.

(56) References Cited

U.S. PATENT DOCUMENTS

| | | | | |
|---|---|---|---|---|
| 6,811,024 | B2 * | 11/2004 | Wieduwilt | B65B 43/52 198/803.13 |
| 6,872,176 | B2 * | 3/2005 | Wyss | B65B 43/285 493/123 |
| 8,096,410 | B2 * | 1/2012 | Kalm | B65G 15/12 198/840 |
| 8,671,651 | B2 * | 3/2014 | Poutot | B65B 5/024 53/398 |
| 8,776,984 | B2 * | 7/2014 | Monti | B65B 35/38 198/432 |
| 8,986,183 | B2 * | 3/2015 | Monti | B65B 43/185 493/162 |
| 9,376,269 | B2 * | 6/2016 | Rodi | B65G 47/34 |
| 10,221,020 | B2 * | 3/2019 | Menke | B65G 47/66 |
| 2005/0150745 | A1 | 7/2005 | Simpson et al. | |
| 2009/0205929 | A1 * | 8/2009 | DeGuglielmo | B65B 5/024 198/347.1 |
| 2011/0173930 | A1 * | 7/2011 | Poutot | B65B 35/36 53/473 |
| 2012/0031737 | A1 * | 2/2012 | Felk | B65B 43/52 198/604 |

FOREIGN PATENT DOCUMENTS

| | | | |
|---|---|---|---|
| JP | 1159847 | A | 1/2015 |
| WO | 9610518 | A1 | 4/1996 |
| WO | 9630261 | A1 | 10/1996 |
| WO | 9746374 | A1 | 12/1997 |
| WO | 2014204583 | A2 | 12/2014 |

OTHER PUBLICATIONS

Written Opinion dated Jan. 19, 2017 re: Application No. PCT/EP2016/073916, pp. 1-5, citing: WO 96/30261 A1.

* cited by examiner

LINE FOR CONVEYING AND FORMING BOX-LIKE BODIES OF DIFFERENT TYPES

TECHNICAL FIELD

The present disclosure relates to a line for conveying and forming box-like bodies of different types.

BACKGROUND

In particular the use is known of two different types of shaped sheets (blanks) for providing box-like bodies that are generally parallelepiped in shape.

In some cases shaped sheets are used (which are cut according to a preset shape, generally by way of a punching process), which, following adapted folding and gluing operations, take on the desired box-like shape structure. In this case the shaped sheets are generally referred to as "flat sheets".

In other cases the shaped sheets, which define the blank to be folded further in order to provide the box-like body, have already been subjected to a first operation of folding and gluing. This second type of shaped sheets, referred to as "pre-glued", has a tubular shape structure and, for storage, is collapsed with respect to two mutually opposite edges.

Both types of shaped sheets ("flat sheets" and "pre-glued sheets") offer numerous mutually competing advantages and therefore makers of machines for packaging have developed several models for operating solely with one type or the other.

The huge difference in encumbrances of "flat sheets" with respect to "pre-glued sheets" in fact determines the need to adopt very different implementation architectures for the lines for conveying and forming the different types of sheets, which translate to several elements for movement.

SUMMARY

The aim of the present disclosure is to solve the above mentioned drawbacks, by providing a line for conveying and forming box-like bodies of different types which is adapted to convey and form box-like bodies starting equally from flat sheets and/or from pre-glued sheets.

Within this aim, the disclosure provides a line for conveying and forming box-like bodies of different types which is adapted to ensure a precise positioning of any type of sheet during the steps for conveying and forming them.

The disclosure provides a line for conveying and forming box-like bodies of different types which is adapted to operate with continuous motion and with alternating motion.

The disclosure also provides a line for conveying and forming box-like bodies of different types which has a different structure with respect to conventional lines.

The disclosure further provides a line for conveying and forming box-like bodies of different types which is low cost, easily and practically implemented and safe in use.

This aim and these and other advantages which will become better apparent hereinafter are achieved by providing a line for conveying and forming box-like bodies of different types, wherein the line for conveying and forming box-like bodies of different types comprises:

at least one suction belt, closed in a loop and arranged at least in its initial portion, at least one strap, closed in a loop and provided with a plurality of protruding teeth, which is parallel to said suction belt and is arranged at least in the end portion of said line and has the initial front substantially juxtaposed with respect to the end portion of said suction belt, and at least one band closed in a loop and provided with a plurality of protruding tabs, which is parallel to said at least one suction belt and to said at least one strap and is arranged along the entire line, and has a start area that is substantially juxtaposed with respect to said at least one suction belt and an end area that is substantially juxtaposed with respect to said at least one strap, said band closed in a loop being movable from a first level of alignment of its upper face with the upper face of said at least one suction belt and of the at least one strap, to a second level, which is separated from the upper face of said at least one suction belt and of the at least one strap by a distance at least equal to the height of said protruding tabs.

BRIEF DESCRIPTION OF THE DRAWINGS

Further characteristics and advantages of the disclosure will become better apparent from the detailed description that follows of a preferred, but not exclusive, embodiment of the line for conveying and forming box-like bodies of different types according to the disclosure, which is illustrated by way of non-limiting example in the accompanying drawings, in which.

DETAILED DESCRIPTION OF THE DRAWINGS

Figure 1:
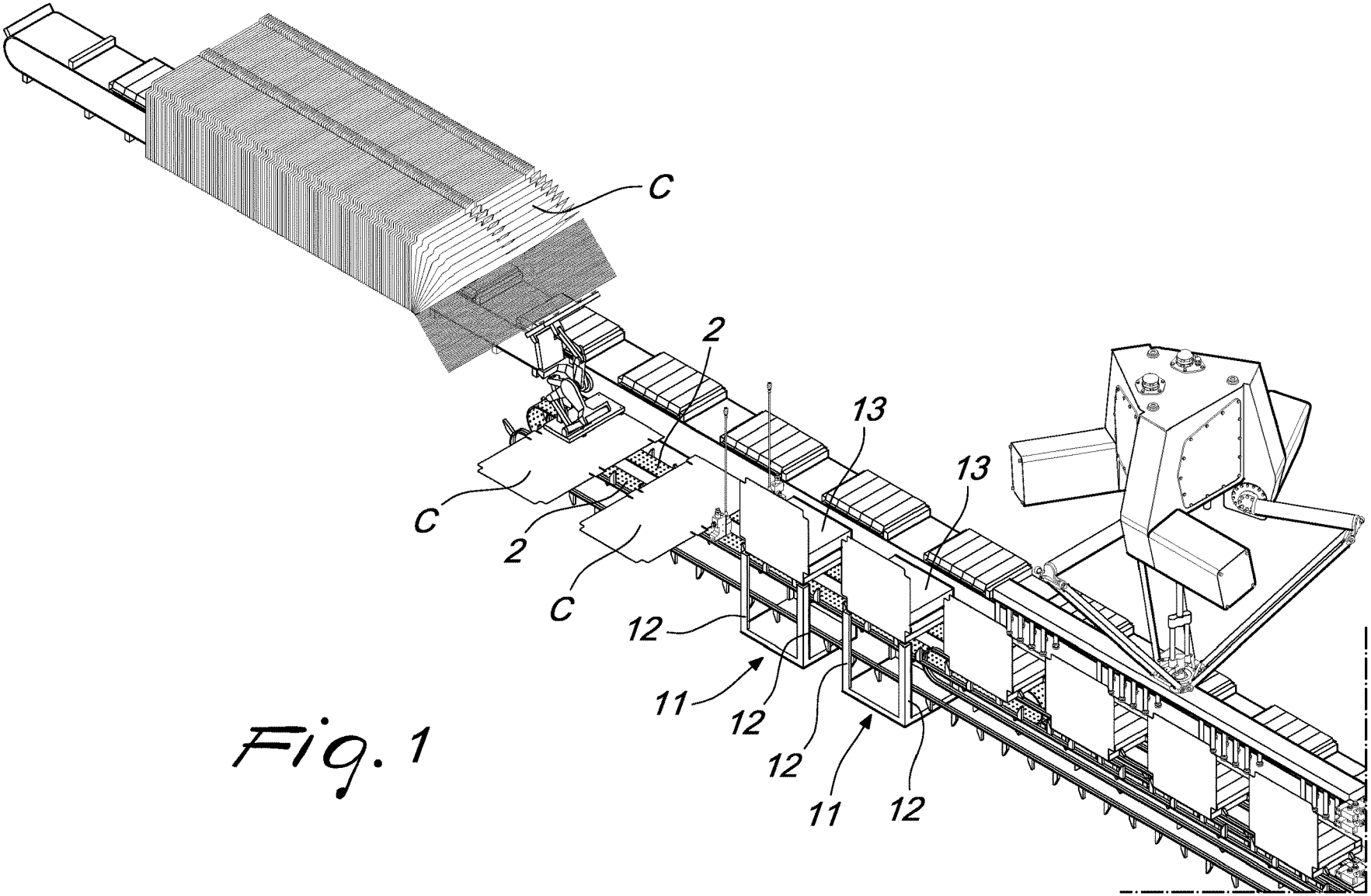
FIG. 1 is a perspective view of a line for conveying and forming box-like bodies of different types according to the disclosure in a first operating mode.

With reference to FIGS. 1-7, the reference numeral 1 generally designates a line for conveying and forming box-like bodies A, B of different types. The line 1 comprises at least one suction belt 2, closed in a loop and arranged at least in its initial portion 3.

The line 1 further comprises at least one strap 4 closed in a loop and provided with a plurality of protruding teeth 5. The strap 4 is parallel to the suction belt 2 (with particular reference to the embodiment shown in the accompanying figures, the strap 4 is arranged outside of the suction belt 2) and is arranged at at least the end portion 6 of the line 1.

It should be noted that the initial front 7 of the strap 4 is substantially juxtaposed (more correctly, they are side-by-side for a predefined length) with the end portion 8 of the suction belt 2.

The above mentioned juxtaposition of the strap 4 and the belt 2 ensures that a sheet C (which is meant to become a box-like body A after the necessary folding and forming operations) can be placed on the line 1 and kept there, thus preventing unwanted movements (the sheet C is retained by the belt 2 by virtue of the sucker effect produced by the suction). During the advancement the sheet C will undergo a series of folding operations that will give it an at least partially box-like shape structure, while it continues to be held by the suction of the belt 2.

Once it has reached the juxtaposed area of the strap 4 and the belt 2, the sheet C, at least partially folded so as to constitute a box-like body A, will also be resting on the at least one strap 4, interposed between successive teeth 5 thereof. From this section onward the box-like body A will be entrained solely by the strap 4 (by virtue of its teeth 5).

The line 1 further comprises at least one band 9 closed in a loop and provided with a plurality of protruding tabs 10.

The band 9 is parallel to the at least one suction belt 2 and to the at least one strap 4 (with particular reference to the embodiment shown in the accompanying figures the band 9 is arranged outside the suction belt 2 and the strap 4) and extends for the entire length of the line 1.

The band 9 has a start area substantially juxtaposed with the at least one suction belt 2 and an end area substantially juxtaposed with the at least one strap 4.

Figure 2:
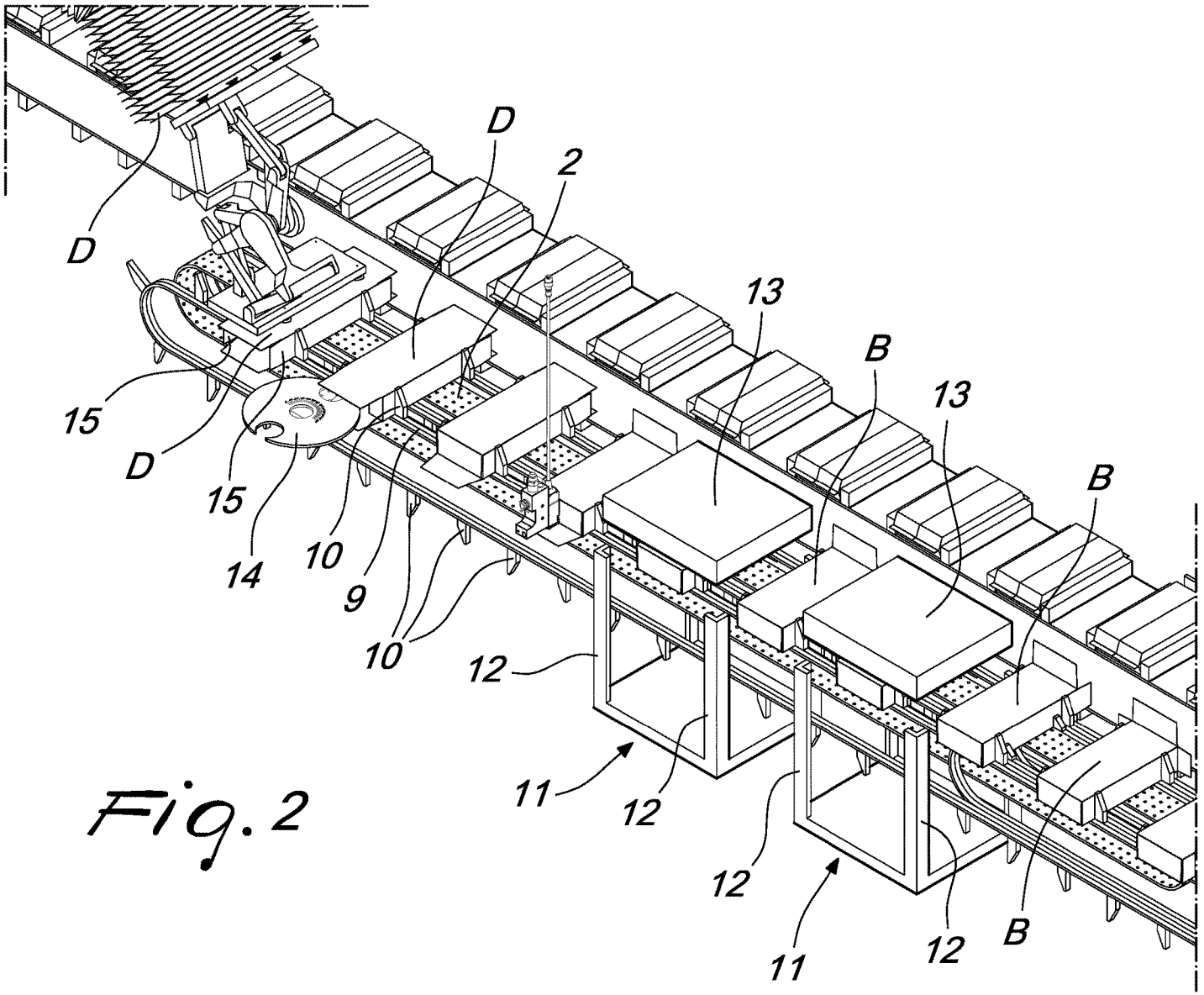
FIG. 2 is a perspective view of a line for conveying and forming box-like bodies of different types according to the disclosure in a second operating mode.
Figure 3:
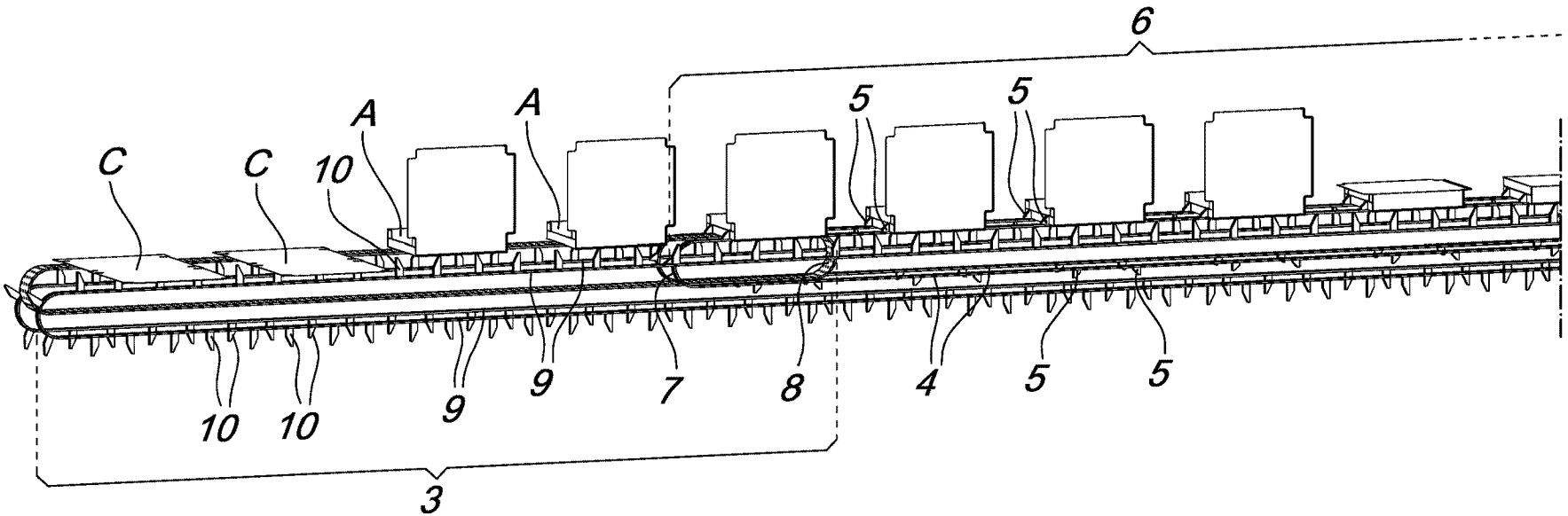
FIG. 3 is a schematic perspective view of the line of FIG. 1.
Figure 4:
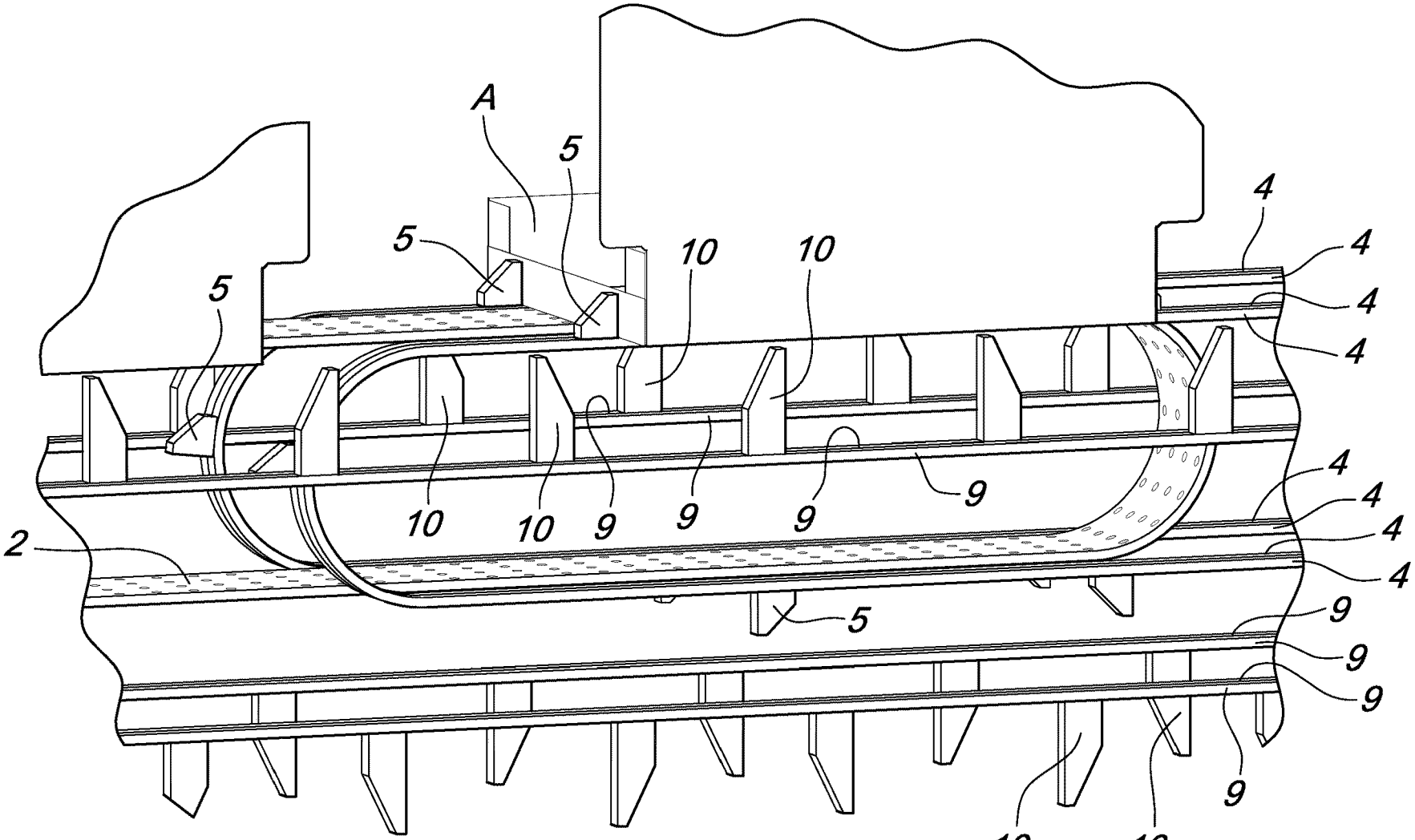
FIG. 4 is an enlarged perspective view of a detail of the line of FIG. 1.
Figure 5:
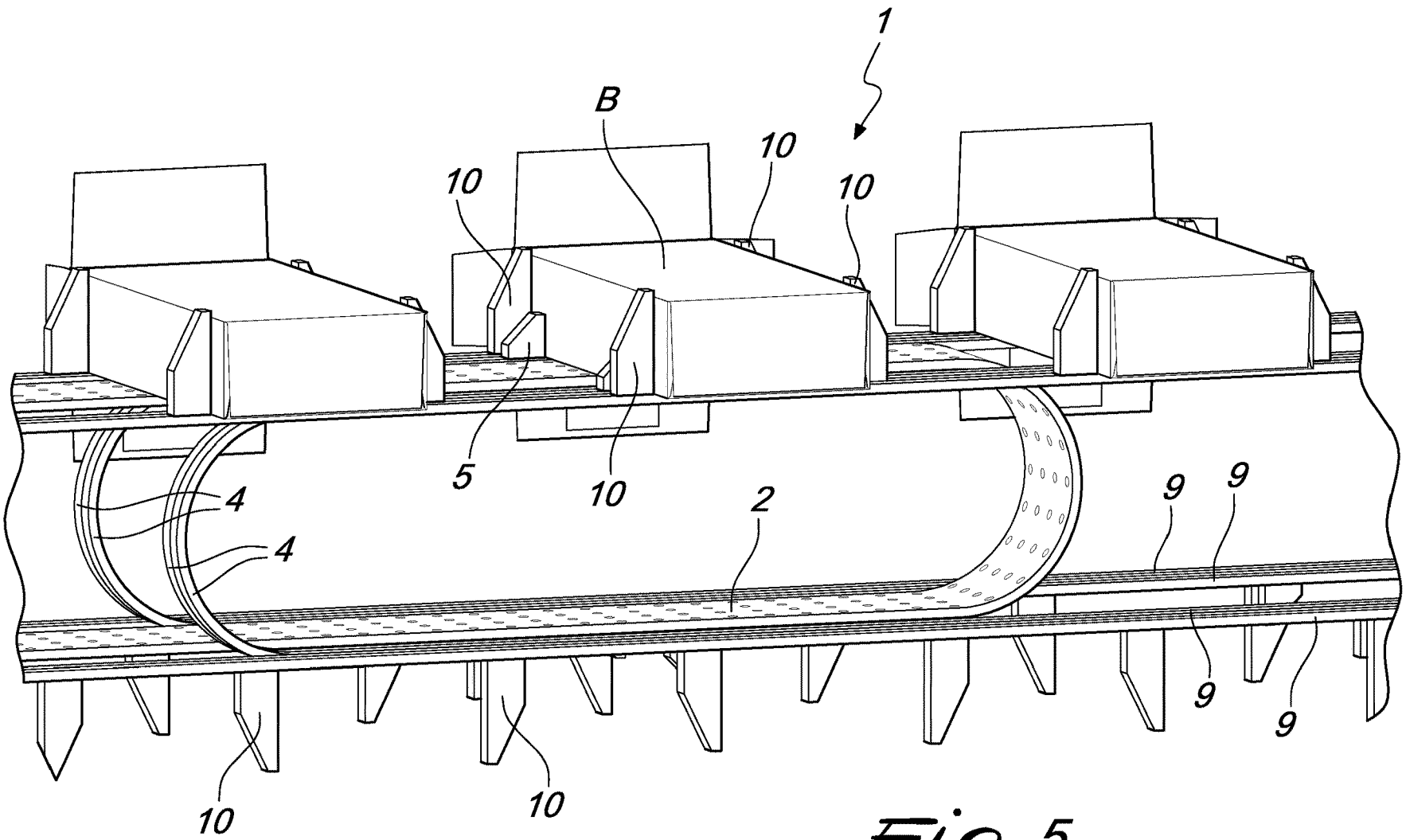
FIG. 5 is an enlarged perspective view of a detail of the line of FIG. 2.
Figure 6:
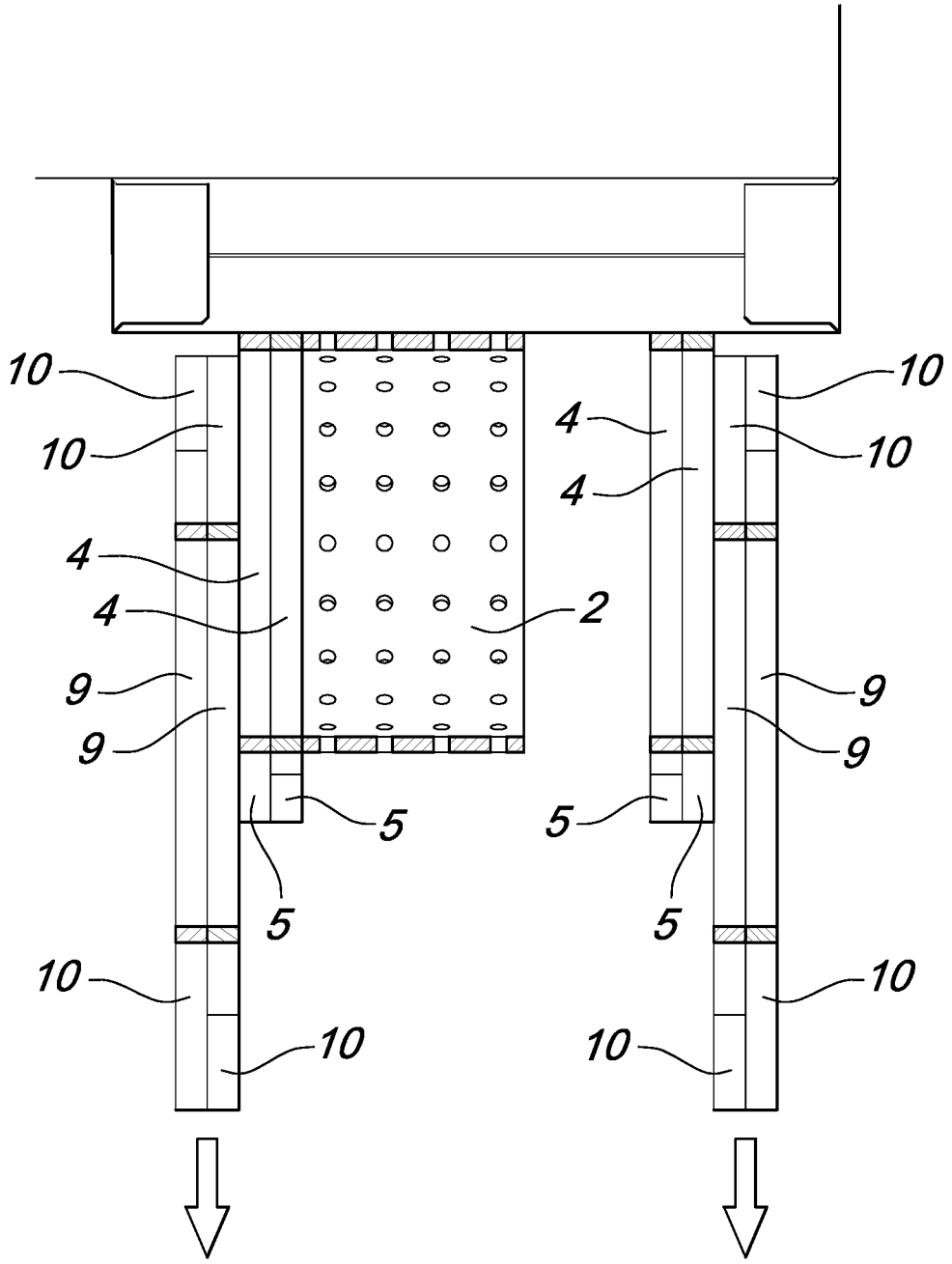
FIG. 6 is a partially cross-sectional front elevation view of the arrangement of some components of the line of FIG. 1.
Figure 7:
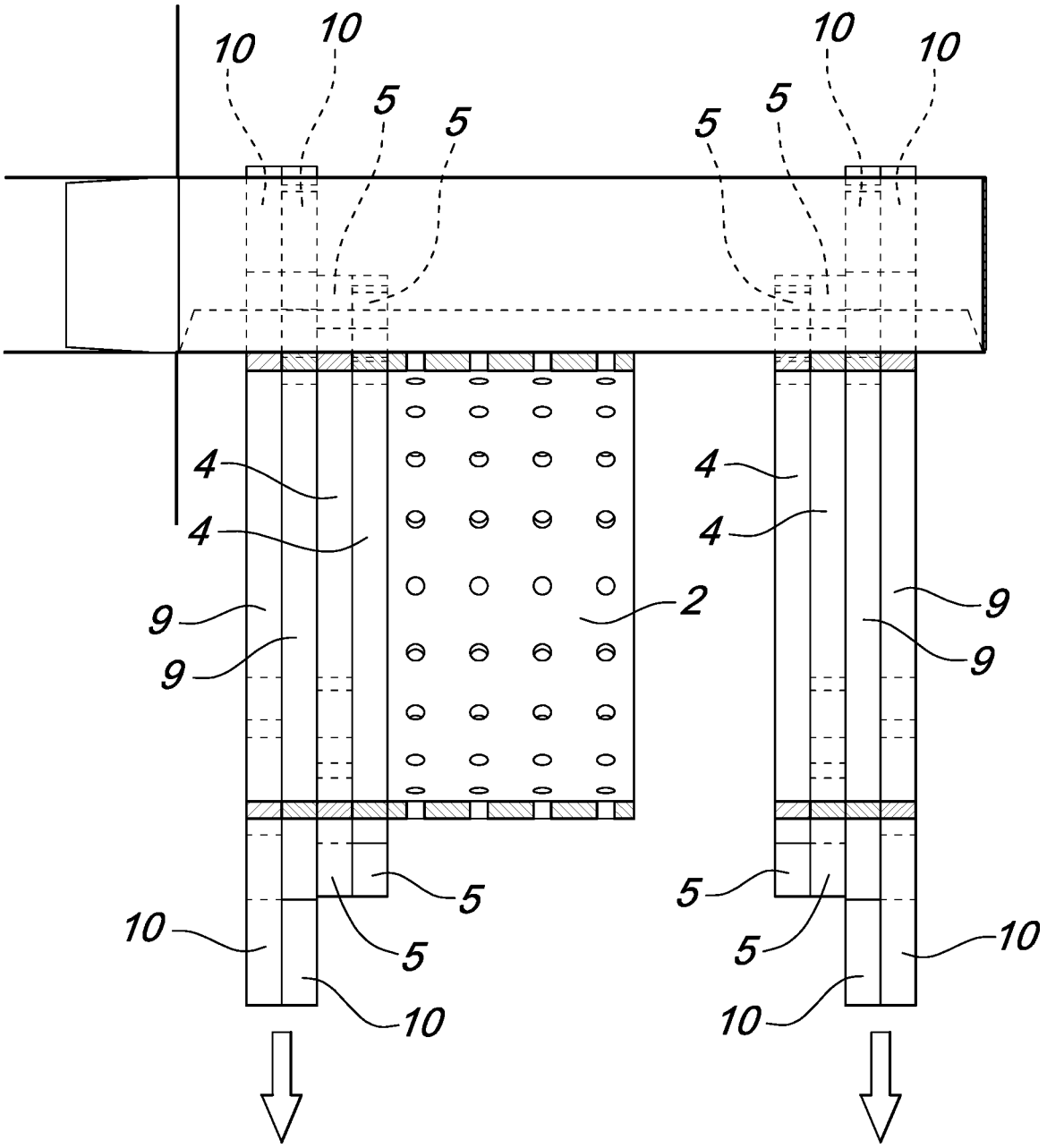
FIG. 7 is a partially cross-sectional front elevation view of the arrangement of some components of the line of FIG. 2.

According to the disclosure, the band 9 can move from a first level of alignment of its upper face with the upper face of the at least one suction belt 2 and of the at least one strap 4 (the arrangement is shown purely for the purposes of example in FIGS. 2, 5, 7), to a second level, which is separated from the upper face of the at least one suction belt 2 and of the at least one strap 4 by a distance at least equal to the height of the protruding tabs 10 (the arrangement is shown purely for the purposes of example in FIGS. 1, 3, 4, 6).

The purpose of the band 9 is to convey pre-glued sheets D, while retaining them (in a partially formed configuration, i.e. having the shape structure of the box-like body B, but open onto at least one of its faces), between two successive protruding tabs 10.

The fact that the at least one band 9 can change its height makes it possible to have a line 1 in which the tabs 10 for the entrainment of the box-like bodies B can be present (in order to convey the box-like bodies B), or absent, in the latter case leaving the task of entraining the sheets C and the box-like bodies A (obtained by forming the sheets C) to the suction belt 2 and to the strap 4.

It is useful to point out that the at least one suction belt 2 will comprise a plurality of suction holes for locking in place a flat sheet C to be subjected to forming.

The spacing between the protruding teeth 5 of each strap 4 closed in a loop will preferably be greater than the width of the at least partially formed box-like body A to be conveyed.

In this manner the box-like body A will be retained between consecutive teeth 5 and therefore no slippages can happen upstream or downstream with respect to its position in the line 1, since it will be retained between teeth 5 that precede it and follow it.

In order to ensure the stable and secure conveyance of the box-like bodies A, the straps 4 closed in loops are at least two in number: at least one first strap 4 will be provided with first protruding teeth 5 designed to abut against the start face of a respective at least partially formed box-like body A to be conveyed, and at least one second strap 4 will be provided with second protruding teeth 5 designed to abut against the end face of the at least partially formed box-like body A.

In this manner the box-like body A will be interposed between mutually opposite teeth 5 which will delimit it, eliminating the risk of its sliding motions, forward or rearward, thus ensuring that its position is always and constantly defined with precision.

Such characteristic is very important both in continuous operation (the line 1 is constantly in motion and the box-like bodies A advance on it without ever stopping), and in alternating operation (the line 1 is periodically temporarily stopped and the box-like bodies A stop in order to undergo specific processing).

Even more specifically, the straps 4 closed in loops are four in number: in fact there will be two first, outer straps 4 (provided with teeth 5 designed to abut against the start faces of a respective box-like body A) and two second, inner straps 4 (provided with teeth 5 designed to abut against the end faces of a respective box-like body A).

In this manner the box-like body A will be locked in place with two teeth 5 on its mutually opposite start and end faces, and any accidental rotation thereof will also be prevented.

It should conveniently be noted that the spacing between the consecutive and corresponding protruding tabs 10 of a same band 9 closed in a loop is greater than the width of the at least partially formed box-like body B to be conveyed. In this manner the box-like body B can be interposed between them and locked in place thereat in order to prevent its sliding motions (forward or rearward) and/or accidental rotations. Preferably the spacing between consecutive tabs will have to be slightly larger than the width of the box-like body B in order to be able to accommodate it substantially without play (and therefore locking it in place precisely and efficaciously).

In a possible embodiment the spacing of the tabs 10 of the band 9 is preferably half the spacing of the teeth 5 of the inner straps 4.

When the band 9 is in the high position the respective tabs 10 will be alternately aligned with the teeth 5, so as to not interfere with each other.

In this manner the straps 4 will be capable of processing substantially large box-like bodies A, while the bands 9 will be adapted to process smaller box-like bodies B, to the benefit of a higher rate of production.

According to an embodiment of undoubted practical and applicative interest, the bands 9 closed in loops are at least two in number: at least one first band 9 will be provided with first protruding tabs 19 designed to abut against the start face of a respective at least partially formed box-like body B to be conveyed, and at least one second band 9 will be provided with second protruding tabs 10 designed to abut against the end face of the at least partially formed box-like body B.

Similarly to what is described for the straps 4, this particular arrangement of the bands 9 makes it possible to precisely control the position of the box-like body B interposed between the protruding tabs 10 of the two separate bands 9.

In this case too, therefore, it is possible to further increase the precision and stability of the locking in place of the box-like body B by adopting four separate bands 9 closed in loops: in particular there will be two first, outer bands 9 and two second, inner bands 9. As in the previous case, the adoption of four separate bands will also eliminate the risk of accidental rotations of the box-like body B during its conveyance (it will in fact be locked in place by four separate protruding tabs 10, two of them abutting against its start face and the other two against its end face).

In order to ensure the correct forming of the box-like body A, the line 1 comprises at least one station 11 for folding a sheet C.

The station 11 comprises movable tapes 12 aligned with a corresponding abutment 13: the translation of the tapes 12 toward the abutment 13, with the interposition of the sheet C, determines the at least partial wrapping of the sheet C onto the abutment 13 with consequent forming of the box-like body A.

The tapes 12 are substantially constituted by laminar angular elements that, by abutting against the sheet C, produce the folding thereof according to predefined lines, which will subsequently constitute the edges of the box-like body A proper.

It should further be noted that the line 1 comprises folding means 14 of the end flaps 15 of the box-like bodies B.

The folding means 14 are substantially aligned with the lateral edge of the line 1.

The folding means 14 are arranged in sequence along the advancement direction of the sheets D and of the box-like bodies B along the line 1 so as to define an at least partial overlapping of the flaps 15, with consequent forming of a closed bottom for the box-like body A.

It should be noted that the line 1 is adapted to operate continuously or in alternation.

In particular it will be possible to operate continuously for processing sheets D in order to provide box-like bodies B and in alternation for processing sheets C in order to provide box-like bodies A. The possibility is not ruled out, however, of adopting different laws of motion (for example continuous in order to provide box-like bodies A and alternating in order to provide box-like bodies B).

Advantageously the present disclosure solves the above mentioned problems, by providing a line 1 for conveying and forming box-like bodies A, B of different types which is adapted to convey and form box-like bodies A, B starting equally from flat sheets C and/or from pre-glued sheets D.

Conveniently, the line 1 is adapted to ensure a precise positioning of any type of sheet C, D during the steps for conveying and forming them: the presence of the teeth 5 and of the protruding tabs 10 ensures a precise and stable positioning of the box-like bodies A and B.

Conveniently the line 1 is adapted to operate with continuous motion and with alternating motion, thus ensuring great operational versatility.

Positively the line 1 has a different structure with respect to conventional lines.

Conveniently the line 1 is low cost and easily and practically implemented, which makes it an apparatus that is safe in industrial use.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The disclosures in Italian Patent Application No. 102015000059464 (UB2015A004217) from which this application claims priority are incorporated herein by reference.

The invention claimed is:

1. A line for conveying and forming boxes of different types, comprising:

at least one suction belt comprising an initial portion, closed in a loop arranged at least in said initial portion, at least one strap, closed in a loop and provided with a plurality of protruding teeth, which is parallel to said suction belt and is arranged at least in an end portion of said line and has an initial front substantially juxtaposed with respect to an end portion of said suction belt, and at least one band closed in a loop and provided with a plurality of protruding tabs, which is parallel to said at least one suction belt and to said at least one strap and is arranged along the entire line, and has a start area that is substantially juxtaposed with respect to said at least one suction belt and an end area that is substantially juxtaposed with respect to said at least one strap, said band closed in a loop comprising an upper face and being movable from a first level of alignment of its upper face with an upper face of said at least one suction belt and an upper face of the at least one strap, to a second level, which is separated from the upper face of said at least one suction belt and of the at least one strap by a distance at least equal to a height of said protruding tabs.

2. The line according to claim 1, wherein said at least one suction belt comprises a plurality of suction holes for locking in place a flat sheet to be subjected to forming.

3. The line according to claim 1, wherein the spacing between said protruding teeth of said at least one strap closed in a loop is greater than a width of an at least partially formed box to be conveyed.

4. The line according to claim 1, wherein said at least one strap closed in the loop are at least two in number, a first strap being provided with first protruding teeth designed to abut against a start face of a respective at least partially formed box to be conveyed, and a second strap being provided with second protruding teeth designed to abut against an end face of said at least partially formed box.

5. The line according to claim 1, wherein said at least one strap closed in the loop are at least four in number, wherein said four straps include two first outer straps and two second inner straps, a first strap being provided with first protruding teeth designed to abut against a start face of a respective at least partially formed box to be conveyed, and a second strap being provided with second protruding teeth designed to abut against an end face of said at least partially formed box.

6. The line according to claim 1, wherein a spacing between said protruding tabs of said at least one band closed in a loop is greater than a width of an at least partially formed box to be conveyed.

7. The line according to claim 1, wherein said at least one band closed in the loop are at least two in number, each band being closed in at least one loop, a first band being provided with first protruding tabs designed to abut against a start face of a respective at least partially formed box to be conveyed, and a second band being provided with second protruding tabs designed to abut against an end face of said at least partially formed box.

8. The line according to claim 1, wherein said at least one band closed in the loop are at least four in number, each band being closed in at least one loop, wherein said at least four straps include two first outer bands and two second inner bands, a first band being provided with first protruding tabs designed to abut against a start face of a respective at least partially formed box to be conveyed, and a second band being provided with second protruding tabs designed to abut against an end face of said at least partially formed box.

9. The line according to claim 1, further comprising at least one station for folding a sheet, said station comprising movable tapes aligned with a corresponding abutment, a translation of said tapes toward said abutment with an interposition of said sheet causing an at least partial wrapping of said sheet onto said abutment with consequent forming of said at least partially formed box.

* * * * *